US005114146A

United States Patent [19]

Booker

[11] Patent Number: 5,114,146

[45] Date of Patent: May 19, 1992

[54] APPARATUS AND METHOD FOR RANDOM SELECTION OF INDICIA

[76] Inventor: Ernest R. Booker, 1229 ½ 22nd St., Santa Monica, Calif. 90404

[21] Appl. No.: 719,949

[22] Filed: Jun. 24, 1991

[51] Int. Cl.[5] ..... A63F 3/06; A47L 13/02

[52] U.S. Cl. ..... 273/144 A; 273/148 R; 15/111; 15/236.07; 30/169; D32/46

[58] Field of Search ..... 273/148 R, 269, 144 A, 273/144 R, 139, 239; 15/111, 105, 236.01, 236.07, 245; 30/169; 283/903, 901, 101, 102; D32/46, 49; D3/62, 64, 61

[56] References Cited

U.S. PATENT DOCUMENTS

| | | | |
|---|---|---|---|
| 2,657,059 | 10/1953 | Selig | 273/239 |
| 2,785,900 | 3/1957 | Selig | 273/144 R |
| 3,901,512 | 8/1975 | Fekete | 273/138 A |
| 4,646,804 | 3/1987 | Damiano | 273/148 R |
| 4,757,567 | 7/1988 | Booker | 15/105 |
| 4,777,693 | 10/1988 | Diba et al. | 15/236.01 |
| 4,881,291 | 11/1989 | Ellis | 15/236.01 |
| 4,977,941 | 12/1990 | Henderson | 273/148 R |

FOREIGN PATENT DOCUMENTS

| | | | |
|---|---|---|---|
| 2066085 | 7/1981 | United Kingdom | 273/239 |

*Primary Examiner*—Benjamin Layno
*Attorney, Agent, or Firm*—Timothy T. Tyson

[57] ABSTRACT

An apparatus (20) for chance selection of indicia to be used in a game, contest or lottery is provided. Markers (24) of a material inherently capable of induced magnetism are stirred in a pouch (26) with a scraper (32) having a permanent magnet (42) therein. Those markers (28) adhering to the scraper when withdrawn from the pouch are noted. The process is continued until a sufficient quantity of indicia is noted. Preferred embodiments of the markers are spherical and discoidal in shape. The scraper can be used, independently, to remove coating over indicia on game cards, lottery tickets and the like.

19 Claims, 2 Drawing Sheets

APPARATUS AND METHOD FOR RANDOM SELECTION OF INDICIA

TECHNICAL FIELD

The present invention pertains to games and more particularly, to indicia selection in games, contests, lotteries and the like.

BACKGROUND ART

A scraper for removing the obscuring coating from game cards and lottery tickets is disclosed in U.S. Pat. No. 4,757,567. The scraper has a blade for removing the coating overlaying indicia and a rabbit's foot for removing the resulting coating debris.

In some games, contests, lotteries and the like a player is entitled to independently select the indicia to be used. The present invention is directed to this selection process.

SUMMARY OF INVENTION

The present invention is directed to apparatus and method for random selection of indicia in games, contests, lotteries and the like.

Apparatus in accordance with the invention are characterized by magnetic means for chance selection of markers having indicia thereon from a plurality of such markers.

In a preferred embodiment markers of material inherently capable of induced magnetism are selected from an enclosing pouch by a permanent magnet enclosed in a scraper. The scraper can be used independently to remove coverings over indicia on game cards, lottery tickets and the like.

The novel features of the invention are set forth with particularity in the appended claims. The invention will be best understood from the following description when read in conjunction with the accompanying drawings.

MODES FOR CARRYING OUT THE INVENTION

Figure 1:
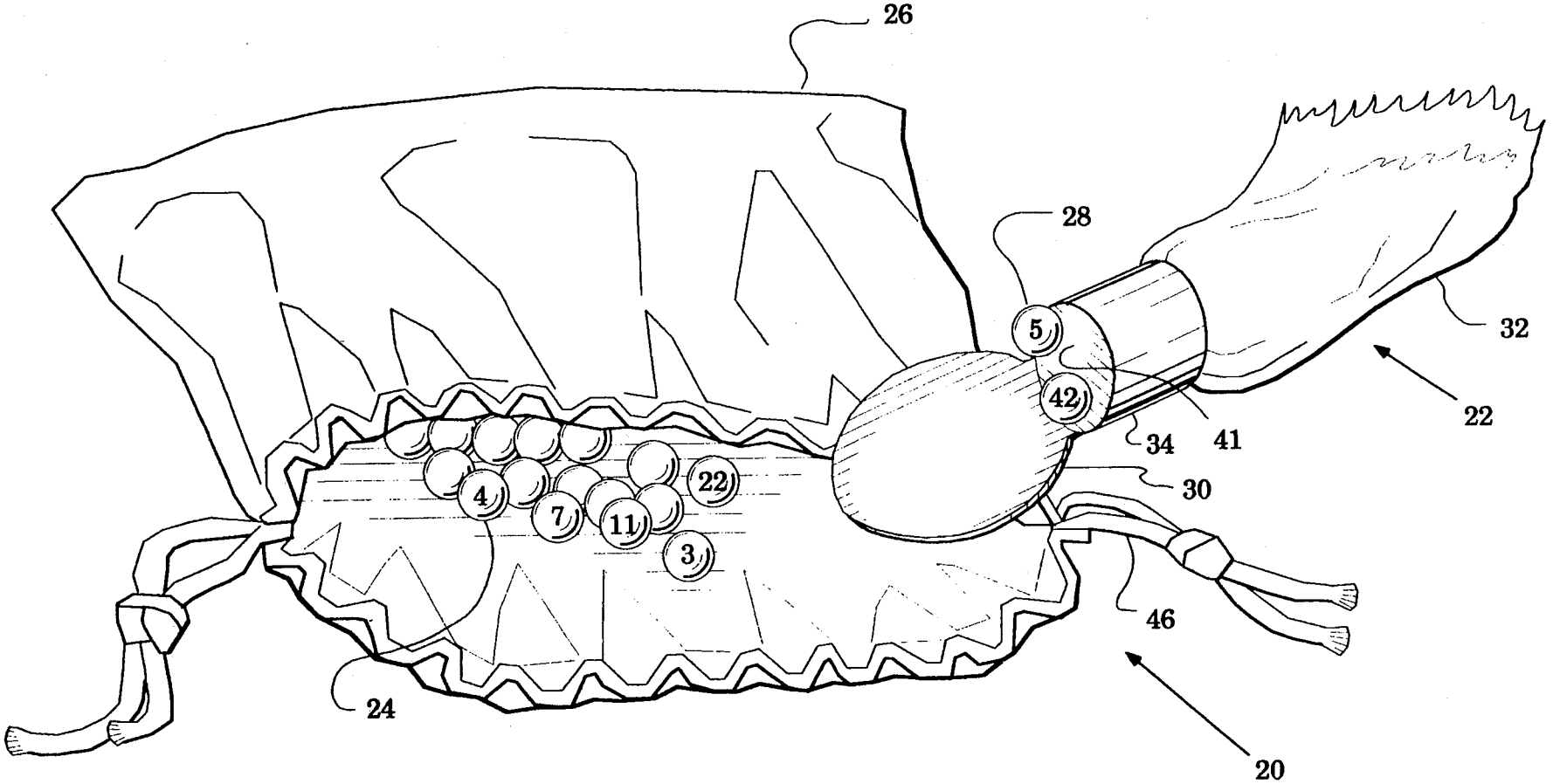
FIG. 1 is a perspective view of an indicia selection apparatus embodiment in accordance with the present invention.

FIG. 1 illustrates an indicia selection apparatus embodiment 20, in accordance with the present invention, for use in selection of indicia required in games, contests, lotteries and the like. In such activities a plurality of indicia, usually numbers, is selected, by a player, as an entry. The selection is often made mentally by choosing indicia at random, by association with events or objects, and the like.

The apparatus 20 provides a way of making a chance selection in which a scraper 22 is used to select, from a plurality of markers 24 in a pouch 26, one or more markers 28. This procedure can be repeated until the desired quantity of indicia have been selected.

Figure 2:
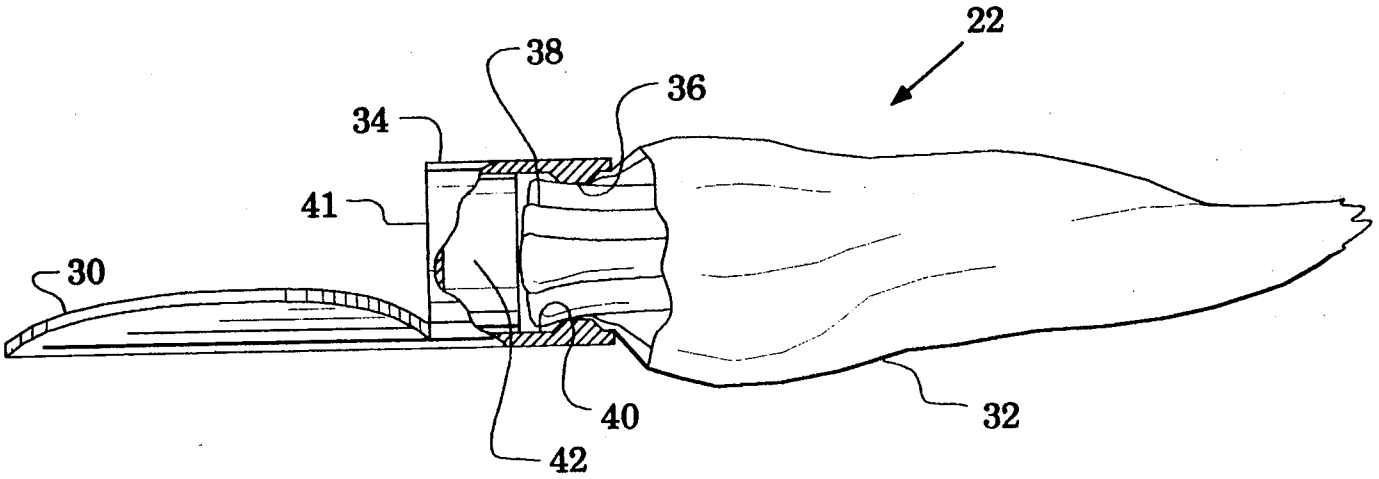
FIG. 2 is a partially sectioned elevation view of a scraper in the indicia selection apparatus of FIG. 1.

The process of selecting the markers 28 will best be understood by referring to FIG. 2 which is a partial sectional elevation view of the scraper 22. The scraper 22 is similar to the scraper disclosed in U.S. Pat. No. 4,757,567 which has a blade 30 attached to a foot of a rabbit 32 by coupling means within a barrel 34. The ridge 36 of the barrel 34 that grasps the ankle end 38 of the foot 32 is an exemplary coupling means as shown in the aforementioned patent. The scraper of the present invention has, additionally, within a cavity 40 and adjacent a face 41 of the barrel 34, a cylindrical pellet 42 of permanently magnetized material (e.g. ferrite). The pellet 42 is retained between the ankle end 38 and the face 41. The voids in the cavity 40 may be filled with an adhesive or potting compound if desired.

Returning now to FIG. 1, the markers 24, 28 are at least partially composed of a material capable of induced magnetism (e.g. iron, ferrite, steel). It is well known that materials capable of induced magnetism become temporary magnets when in the presence of a magnetic field. Thus the markers 28 adhere to the face 41 of the barrel 34 because of the permanent magnet 42 therein and its associated magnetic field.

Having described the scraper, its use in chance selection of indicia may now be understood. The markers 24, 28 and the scraper 22 are normally enclosed in the pouch 26. For selection, the scraper 22 is removed from the pouch 26 and held by the foot 32. The markers 24, 28 are stirred within the pouch 26 by moving the blade 30 thereabout. Then the scraper 22 is withdrawn from the pouch 26. Due to the attraction of the magnetic field of the magnet 42 one or more markers 28 will adhere to the face 41. The indicia on the markers 28 is noted. This process is repeated until a sufficient quantity of indicia have been selected.

The quantity of markers 24 required and the indicia thereon is dictated by the game, contest or lottery for which they are used and may vary accordingly. The markers 24 are sized suitably to allow free movement within the pouch 26 in the stirring step described above so as to facilitate a random selection. The markers 28 adhering to the face 41 may be returned to the pouch between each selection process if desired.

The material of the blade 30 and barrel 34 should be of a material having a low magnetic permeability so that the magnetic field of the magnet 42 is free to extend outward past the face 41. Thus materials such as iron and ferrous compounds should be avoided in fabricating the scraper 22.

The pouch (26 in FIG. 1) is closed with a drawstring 46. Equivalent closing means such as a zipper or hook and eye closures may be substituted.

Figure 3B:
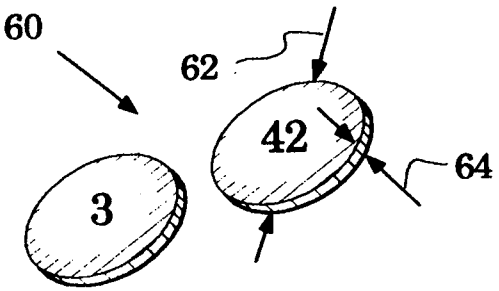
FIG. 3B is an enlarged perspective view of another marker embodiment for the indicia selection apparatus of FIG. 1.
Figure 3A:
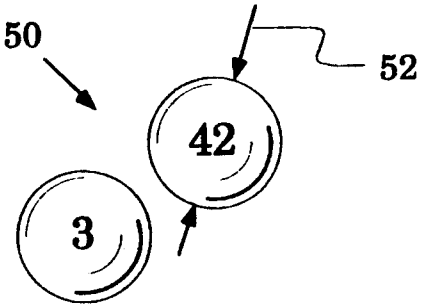
FIG. 3A is an enlarged elevation view of some of the markers in the indicia selection apparatus of FIG. 1.

FIG. 3A is an enlarged view of exemplary markers 50 similar to those illustrated in FIG. 1. The markers 50 are spherical in shape and have indicia thereon suitable for the game, contest or lottery concerned. Accordingly, such indicia may be numbers, letters or the like. As disclosed above, the markers 50 are wholly or partially composed of a material capable of induced magnetism. To facilitate adherence of the markers 50 to the face 41 (shown in FIG. 1), they may be hollow and/or partially composed of other materials chosen to reduce their weight. The diameter 52 of the markers 50 should be less than one inch to facilitate carrying them in the pouch 26. A preferred diameter is approximately one fourth of an inch.

FIG. 3B is an enlarged perspective view illustrating another preferred marker embodiment 60. The markers 60 are discoidal in shape. The diameter 62 of the markers 60 should be less than one inch with a preferred diameter of approximately one fourth of an inch. The thickness 64 of the markers 60 should be less than one fourth of an inch with a preferred thickness of approximately one thirty second of an inch. The markers 60 are otherwise similar to the markers 50.

The scraper 22 may also be used independently in activities involving a game card or lottery ticket in which a coating obscures the indicia. By grasping the foot 32 the blade 30 may be manipulated to remove the coating. By then grasping the blade 30 the debris remaining from the coating may be brushed away with the hair on the foot 32.

From the foregoing it should now be recognized that an indicia selection apparatus has been disclosed herein utilizing magnetic means to make chance indicia selection. Apparatus in accordance with the present invention may be used, as desired by a user thereof, to select indicia or to remove coatings covering indicia. Although the present invention has been described with reference to preferred embodiments, numerous modifications and rearrangements can be made with the equivalent result still embraced within the scope of the invention.

What is claimed is:

1. Indicia selection apparatus, comprising:

a plurality of marker means, each bearing indicia thereon, for indicating an indicia for a game, contest, or lottery;

pouch means for containing said marker means;

scraper means for scraping away a coating covering a game indicia; and magnetic means, in said scraper means, for attracting, from said pouch means, one or more of said marker means and attaching, thereby, said one or more of said marker means thereto;

said marker means and said scraper means stored, when not selecting indicia, in said pouch means.

2. Apparatus as defined in claim 1 wherein said marker means each comprise a material inherently capable of induced magnetism.

3. Apparatus as defined in claim 1 wherein said marker means each have a spherical shape.

4. Apparatus as defined in claim 1 wherein said marker means each have a discoidal shape.

5. Apparatus as defined in claim 1 wherein said marker indicia comprise numbers.

6. Apparatus as defined in claim 1 wherein said pouch means comprises a drawstring for closing thereof.

7. Apparatus as defined in claim 1 wherein said pouch means comprises a hook and eye fastener for closing thereof.

8. Apparatus as defined in claim 1 wherein said pouch means comprises a cloth bag.

9. Apparatus as defined in claim 1 wherein said pouch means comprises a leather bag.

10. Apparatus as defined in claim 1 wherein said magnetic means comprises a pellet of permanently magnetized ferrite.

11. Apparatus as defined in claim 1 wherein said magnetic means comprises a pellet of permanently magnetized iron.

12. Apparatus as defined in claim 1 wherein said scraper means comprises a foot of a rabbit as a handle for grasping thereof.

13. Indicia selection apparatus, comprising:

a plurality of marker means, each bearing one of a plurality of different alphanumeric symbols thereon, for indicating a plurality of alphanumeric symbols for a game, contest, or lottery;

pouch means for containing said marker means; and magnetic means for attracting, from said pouch means, one or more of said marker means and attaching, thereby, said one or more of said marker means thereto;

said magnetic means and said marker means stored, when not selecting indicia, in said pouch means.

14. Apparatus as defined in claim 13 wherein said magnetic means comprises a permanently magnetized pellet.

15. Apparatus as defined in claim 14 wherein said magnetic means comprises scraper means for scraping away a coating covering a game indicia, said pellet contained within said scraper means.

16. Apparatus as defined in claim 15 wherein said magnetic means further comprises a foot of a rabbit for a handle thereof.

17. Apparatus as defined in claim 16 wherein said marker means each comprise a material inherently capable of induced magnetism.

18. A method of selecting a desired quantity of game indicia, comprising the steps of:

opening a pouch and extracting therefrom a scraper having a permanent magnet therein;

stirring, within said pouch, a plurality of markers with said scraper wherein each of said markers comprises a material capable of induced magnetism and having an indicia visible thereon;

withdrawing said scraper from said pouch;

noting the indicia on one or more of said markers adhering, due to the magnetic field of said magnet, to said scraper; and repeating said stirring, withdrawing, removing and noting steps until the desired quantity of game indicia is selected.

19. Method as defined in claim 18 wherein said noting step comprises the step of replacing said one or more of said markers in said pouch.

* * * * *